US009915904B2

(12) United States Patent
Yamashita

(10) Patent No.: US 9,915,904 B2
(45) Date of Patent: Mar. 13, 2018

(54) IMAGE FORMATION SYSTEM, IMAGE FORMING APPARATUS AND IMAGE FORMATION METHOD WITH TONE CORRECTION

(71) Applicant: Konica Minolta, Inc., Tokyo (JP)

(72) Inventor: Takashi Yamashita, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/375,579

(22) Filed: Dec. 12, 2016

(65) Prior Publication Data

US 2017/0168441 A1 Jun. 15, 2017

(30) Foreign Application Priority Data

Dec. 11, 2015 (JP) ..... 2015-242587

(51) Int. Cl.
*G03G 15/00* (2006.01)
*G03G 15/01* (2006.01)

(52) U.S. Cl.
CPC ..... *G03G 15/5058* (2013.01); *G03G 15/0189* (2013.01); *G03G 15/5062* (2013.01); *G03G 15/55* (2013.01); *G03G 2215/0161* (2013.01); *G03G 2215/0164* (2013.01)

(58) Field of Classification Search
CPC ..... G03G 15/5058; G03G 15/5062
USPC ..... 399/15, 72
See application file for complete search history.

(56) References Cited

U.S. PATENT DOCUMENTS 8,582,997 B2 * 11/2013 Nakatsuji et al. . G03G 15/5058 399/72
2009/0033955 A1 2/2009 Harigai

FOREIGN PATENT DOCUMENTS

JP 2005-134677 A 5/2005
JP 2009-033654 A 2/2009
JP 2013-088475 A 5/2013
JP 2015-174442 A 10/2015

OTHER PUBLICATIONS

Office Action issued in corresponding Japanese Application No. 2015-242587 dated Jan. 30, 2018 (13 pages).

* cited by examiner

*Primary Examiner* — William J Royer
(74) *Attorney, Agent, or Firm* — Osha Liang LLP

(57) ABSTRACT

An image formation system includes an image forming section that includes a belt and a roller. The image forming section forms, in a predetermined region of a sheet, either: a first patch image for performing tone correction of a toner image formed on the sheet, or a second patch image for monitoring color variation of the toner image formed on the sheet. The image forming system further includes a controller that controls the image forming section to form only one of the first patch image and the second patch image on any one sheet.

11 Claims, 9 Drawing Sheets

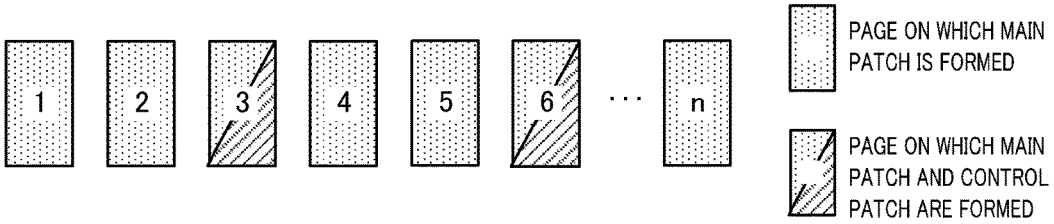
FIG. 5A
CONVENTIONAL

IMAGE FORMATION SYSTEM, IMAGE FORMING APPARATUS AND IMAGE FORMATION METHOD WITH TONE CORRECTION

CROSS REFERENCE TO RELATED APPLICATIONS

This application is entitled to and claims the benefit of Japanese Patent Application No. 2015-242587, filed on Dec. 11, 2015, the disclosure of which including the specification, drawings and abstract is incorporated herein by reference in its entirety.

BACKGROUND OF THE INVENTION

1. Field of the Invention

The present invention relates to an image formation system, an image forming apparatus and an image formation method.

2. Description of Related Art

In general, an electrophotographic image forming apparatus (such as a printer, a copy machine, and a fax machine) is configured to irradiate (expose) a charged photoconductor (image bearing member) with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed. Further, the toner image formed in the above-mentioned manner is directly or indirectly transferred to a sheet, followed by heating and pressurization, whereby a toner image is formed on the sheet.

In an image forming apparatus, the image density of the toner image formed on a sheet may vary due to change of the environment (such as temperature and humidity) around the apparatus, degradation with time of the photoconductor or the developer, or the like. Image formation systems including an image forming apparatus perform tone correction for the purpose of stabilizing the image density (see, for example, Japanese Patent Application Laid-Open No. 2009-33654).

For example, an image formation system is known in which an after-processing apparatus including an inline sensor is disposed on the downstream side in the sheet conveyance direction of the image forming apparatus, and tone correction is performed in real time. In such an image formation system, the image forming apparatus forms a document image at a position inside a predetermined frame on a sheet, and forms a toner patch composed of a plurality of color patterns (hereinafter referred to as "main patch") for tone correction at a position outside the frame on a sheet. Then, the inline sensor of the after-processing apparatus detects the image density of the main patch, and outputs the detected image density to the image forming apparatus. The image forming apparatus generates tone correction data based on the image density output from the inline sensor, and performs tone correction in real time.

In some situation, color variation of the toner image formed by the image forming apparatus on the sheet is confirmed by use of an external colorimeter in accordance with the request of the user or the like. In this case, from an external apparatus such as a PC connected with the image forming apparatus, the user outputs to the image forming apparatus document data in which a toner patch (hereinafter referred to as "control patch") for confirming color variation of the toner image by use of the colorimeter is disposed at a position outside the document image, as a printing job. The image forming apparatus forms a control patch at a position outside the document image.

However, in an image formation system that performs tone correction in real time while executing a printing job including document data in which a control patch is disposed, the control patch and the main patch may overlap on the same sheet. When the control patch and the main patch overlap on the same sheet, the image density of the main patch detected by the inline sensor may differ from the original image density of the main patch, and consequently real-time tone correction cannot be normally performed. In addition, the external colorimeter cannot confirm color variation of the control patch formed on a sheet.

SUMMARY OF THE INVENTION

One or more embodiments of the present invention provide an image formation system, an image forming apparatus, and an image formation method which can normally perform tone correction.

An image formation system according to one or more embodiments of the present invention includes a plurality of units including an image forming apparatus configured to form a toner image on a plurality of sheets, the image formation system including: a first patch image formation section configured to form in a predetermined region of the sheet a first patch image for performing tone correction of a toner image formed on the sheet; a second patch image formation section configured to form in the predetermined region of the sheet a second patch image for monitoring color variation of the toner image formed on the sheet; and a control section (or controller) configured to control the first patch image formation section and the second patch image formation section such that the first patch image and the second patch image are not formed on one sheet.

In one or more embodiments of the image formation system, in a setting in which the first patch image and the second patch image are formed in the predetermined region of one sheet, the control section selectively carries out one of a first patch mode and a second patch mode, the first patch mode being a mode for forming the first patch image without forming the second patch image in the predetermined region, the second patch mode being a mode for forming the second patch image without forming the first patch image in the predetermined region.

In one or more embodiments of the image formation system, the control section switches a mode to be carried out between the first patch mode and the second patch mode for each printing job.

In one or more embodiments of the image formation system, after the second patch mode is continuously carried out for a predetermined number of sheets, the control section operates to carry out the first patch mode for a sheet which is set to be subjected to formation of the first patch image and the second patch image in the predetermined region.

In one or more embodiments of the image formation system, when a setting for forming the second patch image in the predetermined region of a sheet is made in a monitoring mode in which the first patch image is formed on the sheet without performing the tone correction, the control section operates to form the second patch image without forming the first patch image in the predetermined region of the sheet.

An image forming apparatus according to one or more embodiments of the present invention forms a toner image on a plurality of sheets, the image forming apparatus including: a first patch image formation section configured to form in a predetermined region of the sheet a first patch image for performing tone correction of a toner image formed on the sheet; a second patch image formation section configured to form in the predetermined region of the sheet a second patch image for monitoring color variation of the toner image formed on the sheet; and a control section configured to control the first patch image formation section and the second patch image formation section such that the first patch image and the second patch image are not formed on one sheet.

An image formation method according to one or more embodiments of the present invention is a method of forming a toner image on a plurality of sheets, the method including: forming in a predetermined region of the sheet a first patch image for performing tone correction of a toner image formed on the sheet; forming in the predetermined region of the sheet a second patch image for monitoring color variation of the toner image formed on the sheet; and controlling a timing of forming the first patch image and the second patch image such that the first patch image and the second patch image are not formed on one sheet.

BRIEF DESCRIPTION OF DRAWINGS

Advantages and features of the present invention will become more fully understood from the detailed description given hereinbelow and the appended drawings which are given by way of illustration only, and thus are not intended as a definition of the limits of the present invention, and wherein:

FIG. 5A shows results of printing in the case where the printing job illustrated in FIG. 4 is carried out with a conventional image forming apparatus;

DESCRIPTION OF THE EMBODIMENTS

Hereinafter, embodiments of the present invention will be described with reference to the drawings. However, the scope of the invention is not limited to the illustrated examples.

In the following, embodiments of the present invention are described in detail with reference to the drawings.

[Configuration of Image Formation System 1]

Figure 1:
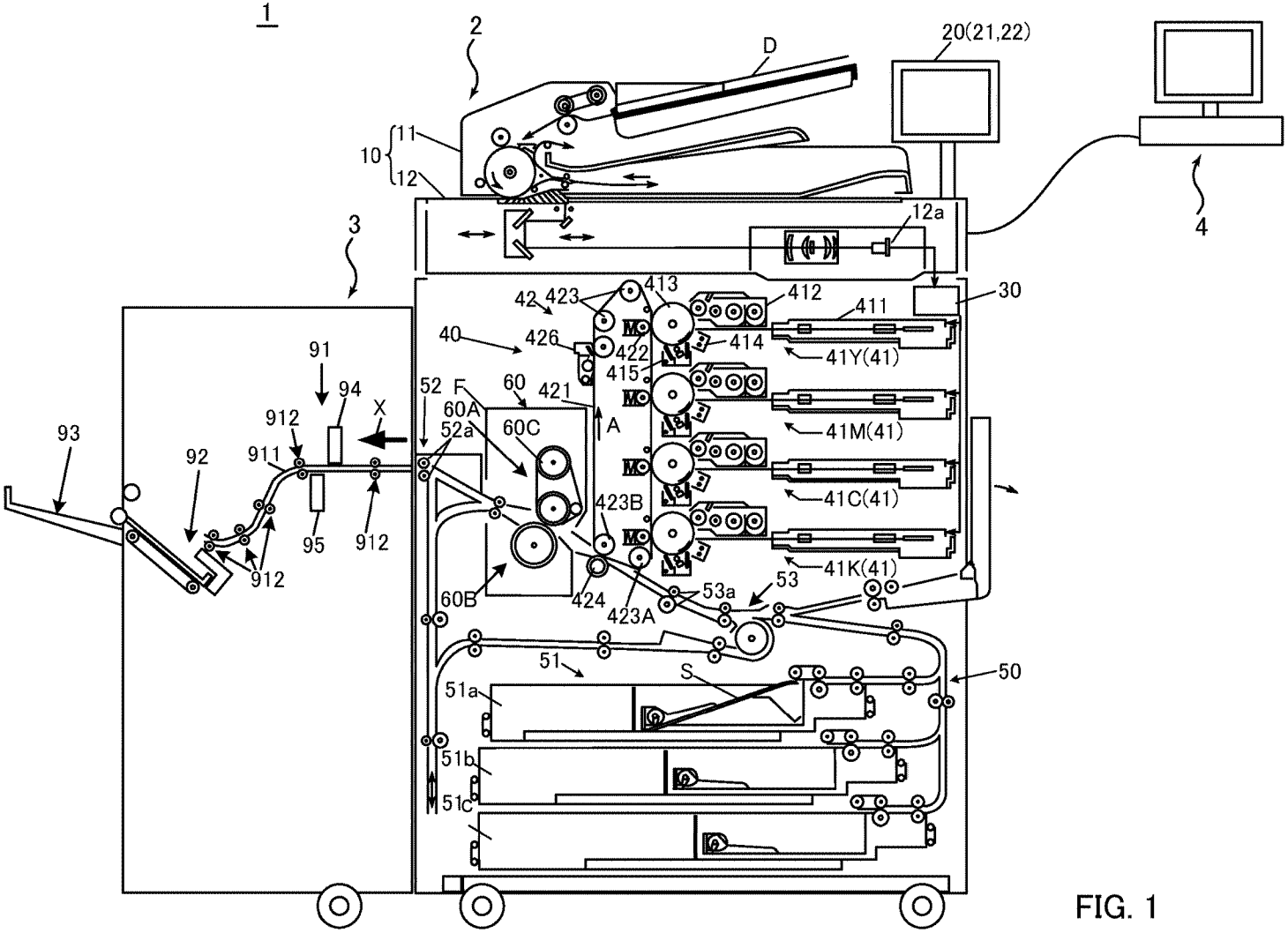
FIG. 1 illustrates a general configuration of an image formation system according to one or more embodiments.
Figure 2:
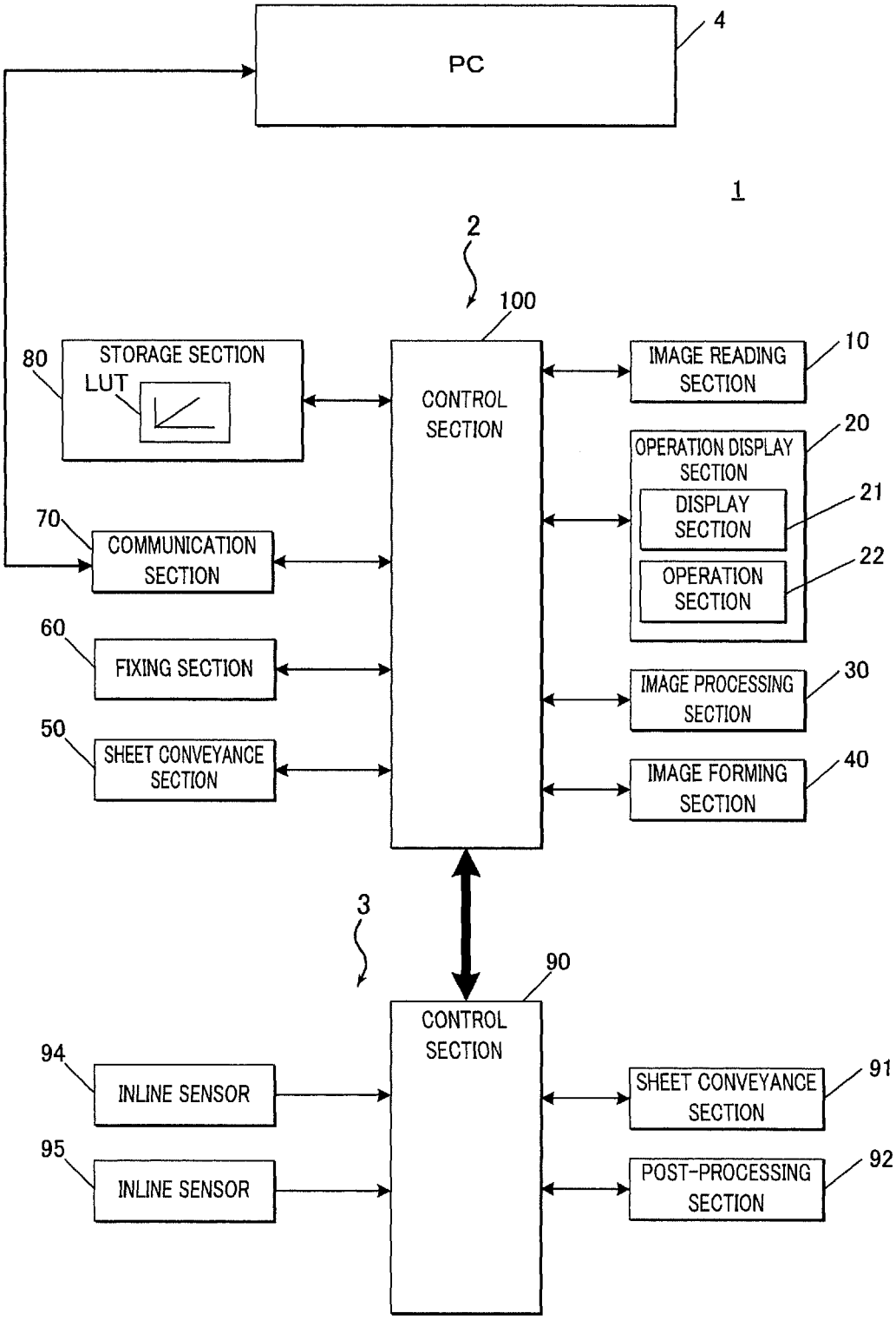
FIG. 2 illustrates a principal part of a control system of the image formation system according to one or more embodiments.

FIG. 1 schematically illustrates a general configuration of image formation system 1 according to one or more embodiments. FIG. 2 illustrates a principal part of a control system of image formation system 1 according to one or more embodiments. As illustrated in FIG. 1, image formation system 1 has a configuration in which external post-processing apparatus (after-processing apparatus) 3 is connected to a lateral side (in FIG. 1, left side) of image forming apparatus 2. In addition, image formation system 1 is connected with personal computer (PC) 4 as an external apparatus.

Image forming apparatus 2 illustrated in FIGS. 1 and 2 is a color image forming apparatus of an intermediate transfer system using electrophotographic process technology. That is, image forming apparatus 2 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image formation system 1 secondary-transfers the resultant image to sheet S, thereby forming an image.

A longitudinal tandem system is adopted for image forming apparatus 2. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

In addition, for the purpose of performing real-time tone correction in image formation system 1, image forming apparatus 2 forms a patch (hereinafter referred to as "main patch") composed of a plurality of color patterns for performing tone correction in a predetermined range of a sheet. In addition, after-processing apparatus 3 detects the image density of the main patch in the predetermined range, and outputs the detected image density to image forming apparatus 2. Image forming apparatus 2 performs tone correction based on the image density output from after-processing apparatus 3.

As illustrated in FIG. 2, image forming apparatus 2 includes image reading section 10, operation display section 20, image processing section 30, image forming section 40, sheet conveyance section 50, fixing section 60, communication section 70, storage section 80 and control section (or controller) 100.

Control section 100 includes central processing unit (CPU), read only memory (ROM), random access memory (RAM) and the like. The CPU reads a program suited to processing contents out of the ROM, develops the program in the RAM, and integrally controls an operation of each block of image forming apparatus 2 in cooperation with the developed program. At this time, CPU refers to various kinds of data stored in storage section 80. Storage section 80 is composed of, for example, a non-volatile semiconductor memory (so-called flash memory) or a hard disk drive.

Control section 100 transmits and receives various data to and from PC 4 connected to a communication network such as a local area network (LAN) or a wide area network (WAN), through communication section 70. Control section 100 receives, for example, image data transmitted from PC 4, and performs control to form an image on sheet S on the basis of the image data (input image data). Communication section 70 is composed of, for example, a communication control card such as a LAN card.

Image reading section 10 includes auto document feeder (ADF) 11, document image scanner (scanner) 12, and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image conditions, operating statuses of functions, and the like in accordance with display control signals received from control section 100. Operation section 22 includes various operation keys such as numeric keys and a start key, receives various input operations performed by a user, and outputs operation signals to control section 100.

Image processing section 30 includes a circuit that performs a digital image process suited to initial settings or user settings on the input image data, and the like. For example, image processing section 30 performs tone correction on the basis of tone correction data (tone correction table), under the control of control section 100. In addition, under the control of control section 100, image processing section 30 gives the input image data a main patch for generating tone correction data. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K that form images of colored toners of a Y component, an M component, a C component, and a K component on the basis of the image data processed with image processing section 30; intermediate transfer unit 42; and the like.

In addition, image forming section 40 functions as a first patch image formation section that forms, in a predetermined region of a sheet, a main patch for performing tone correction of a toner image to be formed on a sheet.

Image forming units 41Y, 41M, 41C, and 41K for the Y component, the M component, the C component, and the K component have similar configurations. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413 (photoconductor), charging device 414, drum cleaning device 415 and the like.

Photoconductor drum 413 is, for example, a negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 80 [mm]. The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 100 controls a driving current supplied to a driving motor (not shown in the drawings) that rotates photoconductor drums 413, whereby photoconductor drums 413 is rotated at a constant circumferential speed.

Charging device 414 evenly negatively charges the surface of photoconductor drum 413. Exposure device 411 is composed of, for example, a semiconductor laser, and configured to irradiate photoconductor drum 413 with laser light corresponding to the image of each color component. The positive charge is generated in the charge generation layer of photoconductor drum 413 and is transported to the surface of the charge transport layer, whereby the surface charge (negative charge) of photoconductor drum 413 is neutralized. An electrostatic latent image of each color component is formed on the surface of photoconductor drum 413 by the potential difference from its surroundings.

Developing device 412 is a developing device of a two-component developing type, and attaches toners of respective color components to the surface of photoconductor drums 413, and visualizes the electrostatic latent image to form a toner image.

Drum cleaning device 415 includes a drum cleaning blade that is brought into sliding contact with the surface of photoconductor drum 413, and removes residual toner that remains on the surface of photoconductor drum 413 after the primary transfer. A drum unit including photoconductor drum 413 is provided with a lubricant coater that applies to photoconductor drum 413 lubricant in the form of powder which has been scraped by a lubricant application brush.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. For example, driving roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in arrow A direction at a constant speed.

Intermediate transfer belt 421 is a belt having conductivity and elasticity which includes on the surface thereof a high resistance layer having a volume resistivity of 8 to 11 [log Ω·cm]. Intermediate transfer belt 421 is rotationally driven by a control signal from control section 100. It is to be noted that the material, thickness and hardness of intermediate transfer belt 421 are not limited as long as intermediate transfer belt 421 has conductivity and elasticity.

Primary transfer roller 422 is a foamed roller including a mandrel and an elastic layer that covers the outer periphery of the mandrel. The material of the mandrel is a metal such as aluminum. The material of the elastic layer is a conductive polyurethane foam. Primary transfer rollers 422 are disposed on the inner periphery side of intermediate transfer belt 421 to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, at a position on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to secondary transfer roller 424, and an electric charge of the polarity opposite to the polarity of the toner is applied to the rear side (the side that makes contact with secondary transfer roller 424) of sheet S, whereby the toner image is electrostatically transferred to sheet S. Sheet S on which the toner images have been transferred is conveyed toward fixing section 60.

Belt cleaning device 426 removes transfer residual toner which remains on the surface of intermediate transfer belt 421 after a secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes upper fixing section 60A having a fixing side member disposed on a fixing surface (the surface on which a toner image is formed) side of sheet S, lower fixing section 60B having a back side supporting member disposed on the rear surface (the surface opposite to the fixing surface) side of sheet S, heating source 60C, and the like. The back side supporting member is brought into pressure contact with the fixing side member, whereby a fixing nip for conveying sheet S in a tightly sandwiching manner is formed.

At the fixing nip, fixing section 60 applies heat and pressure to sheet S on which a toner image has been secondary-transferred to fix the toner image on sheet S. Fixing section 60 is disposed as a unit in fixing part F. In addition, fixing part F may be provided with an air-separating unit that blows air to separate sheet S from the fixing side member or the back side supporting member.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 includes a plurality of pairs of conveyance rollers such as a pair of registration rollers 53*a*.

Sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected to after-processing apparatus 3 by sheet ejection section 52 including sheet ejection rollers 52*a*.

After-processing apparatus 3 sequentially takes in the sheets ejected from image forming apparatus 2, and performs a process of aligning the ends of a plurality of sheets (so-called alignment process) as the post-processing, for example. In addition, after-processing apparatus 3 may perform a binding process with a stapler on a batch of the sheets after the alignment process. In addition to the above-mentioned processes, the post-processing carried out in after-processing apparatus 3 include a punching process for making a hole at a designated position, a folding process for folding a sheet, and the like, for example. The post-processing carried out with after-processing apparatus 3 is selected based on the request of the user.

As illustrated in FIGS. 1 and 2, after-processing apparatus 3 includes control section 90, sheet conveyance section 91, post-processing section 92, and inline sensors 94 and 95.

Control section 90 performs a centralized control of operations of after-processing apparatus 3 in conjunction with control section 100 of image forming apparatus 2. To be more specific, control section 90 controls the operations of sheet conveyance section 91, post-processing section 92 and inline sensors 94 and 95 based on a control signal, information of a printing job and the like sent from control section 100 of image forming apparatus 2.

Sheet conveyance section 91 includes conveyance path 911 that connects sheet ejection section 52 of image forming apparatus 2 and post-processing section 92. A plurality of conveyance roller pairs 912 are provided on conveyance path 911.

Conveyance path 911 is a path for conveying sheet S ejected from image forming apparatus 2 to post-processing section 92. Control section 90 controls the rotation of conveyance roller pair 912 to convey sheet S ejected from image forming apparatus 2 in the sheet conveyance direction (the arrow X direction of FIG. 1).

Post-processing section 92 is configured to perform the post-processing on sheet S under control of control section 90. Post-processing section 92 ejects sheet S on which the post-processing has been performed to paper tray 93.

Inline sensors 94 and 95 are charge-coupled device (CCD) sensors, for example. For the purpose of performing tone correction in image forming apparatus 2, inline sensors 94 and 95 detect the image density of the main patch formed on a sheet.

Inline sensor 94 is provided on the upper side of conveyance path 911 in the vertical direction in after-processing apparatus 3. Specifically, inline sensor 94 is provided at a position where the main patch formed on the front surface of a sheet ejected from image forming apparatus 2 can be detected in the vertical direction in after-processing apparatus 3. Inline sensor 94 detects the image density of the main patch formed on the front surface of the sheet, and outputs the detected image density to control section 90. Control section 90 outputs to control section 100 of image forming apparatus 2 the image density output from inline sensor 94.

Inline sensor 95 is provided on the lower side of conveyance path 911 in the vertical direction in after-processing apparatus 3. Specifically, inline sensor 95 is provided at a position where the main patch formed on the rear surface of a sheet ejected from image forming apparatus 2 can be detected in the vertical direction in after-processing apparatus 3. Inline sensor 95 detects the image density of the main patch formed on the rear surface of the sheet, and outputs the detected image density to control section 90. Control section 90 outputs to control section 100 of image forming apparatus 2 the image density output from inline sensor 95.

PC 4 is connected with communication section 70 of image forming apparatus 2, and exchanges various data. To be more specific, PC 4 performs a raster image processor (RIP) process of converting information of an image into image data to be output to image forming apparatus 2. In addition, in the RIP process, PC 4 places a patch (hereinafter referred to as "control patch") including various pieces of information at a position outside the image, and performs the RIP process. Then, a printing job composed of image data including the control patch is sent to image forming apparatus 2 through communication section 70.

At this time, image forming section 40 functions as a second patch image formation section that forms, in a predetermined region of the sheet, a control patch for monitoring color variation of the toner image to be formed on the sheet.

The control patch is composed of a plurality pieces of color information for confirming color variation of output images by use of the colorimeter, character strings such as printing dates and times and job names of printing jobs, and the like.

The control patch may be provided in each page of a plurality of pages in a unit of printing job, or may be provided in one or more designated pages of a plurality of pages.

In image formation system 1 according to one or more embodiments, image forming apparatus 2 forms a document image on a sheet having a size greater than that of the document image. The unnecessary portion of the sheet on which the document image is formed and ejected from after-processing apparatus 3 is cut with an external cutter (not illustrated), and thus a printed sheet is obtained. Then, image forming apparatus 2 forms a main patch at a position outside a document image to perform tone correction in real time. In addition, when receiving a printing job composed of image data including a control patch from PC 4, image forming apparatus 2 forms a control patch at a position outside the document image.

Next, with reference to FIG. 3, a printing region of a sheet ejected from image forming apparatus 2 according to one or more embodiments will be described.

Figure 3:
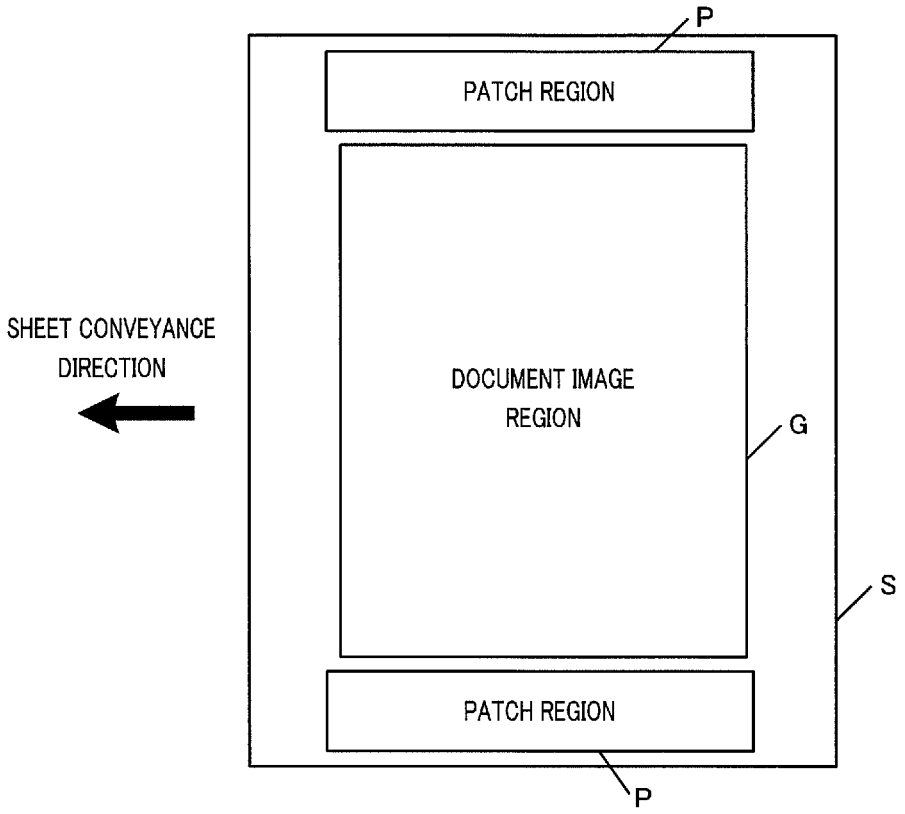
FIG. 3 illustrates an example of a printing region of a sheet subjected to printing in the image forming apparatus.

As illustrated in FIG. 3, image forming apparatus 2 forms a document image in document image region G on sheet S having a size greater than that of the document image. At this time, the region outside document image region G is a cutting part. The region outside document image region G of sheet S in which a document image is formed in document image region G is cut with a cutter, and thus a printed sheet is obtained.

In the case where image formation system 1 performs tone correction in real time, the main patch is formed in patch region P which is the region outside document image region G and is cut with the cutter.

In addition, in the case where a control patch is included in the image data of a printing job sent from PC 4, image forming apparatus 2 forms a control patch in patch region P provided outside document image region G.

In the case where image formation system 1 performs tone correction in real time and a control patch is included in the image data of a printing job sent from PC 4, image forming apparatus 2 forms a main patch and a control patch in patch region P provided outside the document image region G. When both of the main patch and the control patch are formed in patch region P, the information of the color of the main patch read by inline sensors 94 and 95 of after-processing apparatus 3 differs from that of the original main patch, and tone correction in real time cannot be normally performed. In addition, it is impossible to confirm color variation with an external colorimeter.

In view of this, image forming apparatus 2 has a main patch priority mode of preferentially forming only a main patch in patch region P, and a control patch priority mode of preferentially forming only a control patch in patch region P, and image forming apparatus 2 forms a patch in one of the modes. The main patch priority mode or the control patch priority mode is set by operation of operation section 22 by the user, for example.

Next, with reference to FIG. 4 and FIGS. 5A to 5C, the main patch priority mode and the control patch priority mode will be described.

Figure 4:
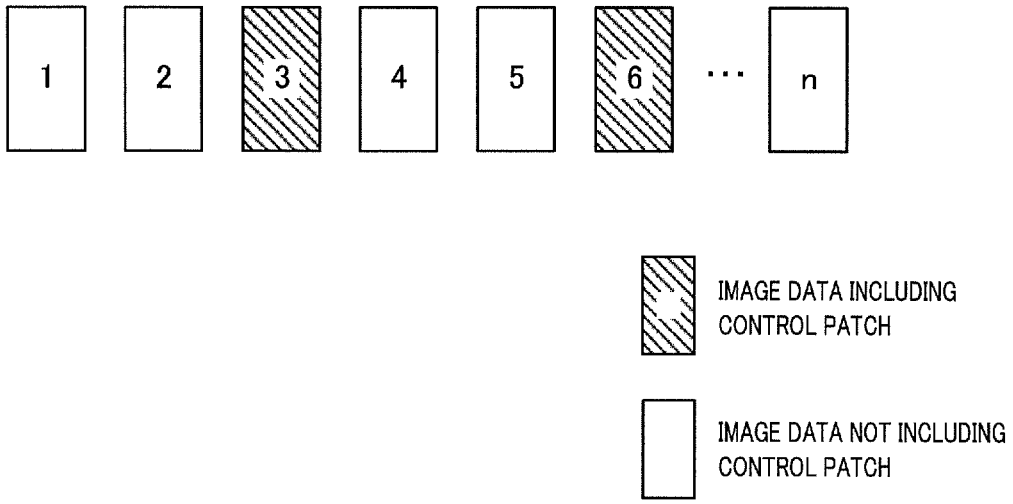
FIG. 4 illustrates an example of a printing job.

FIG. 4 illustrates an example of a printing job output from PC 4 to image forming apparatus 2. The printing job illustrated in FIG. 4 is a printing job in which a control patch is included in image data of the third page and the sixth page, in image data of n pages.

Image forming apparatus 2 forms a main patch in each page when printing based on the printing job illustrated in FIG. 4 is performed in tone correction.

FIG. 5A illustrates results of printing in the case where the printing job illustrated in FIG. 4 is carried out with a conventional image forming apparatus. When executing the printing job illustrated in FIG. 4, a conventional image forming apparatus forms an image by providing each page with a main patch. In this case, as illustrated in FIG. 5A, both of the main patch and the control patch are formed in the third page and the sixth page. Since the main patch and the control patch overlap each other, tone correction based on the image density of the main patch cannot be normally performed in the third page and the sixth page.

Figure 5B:
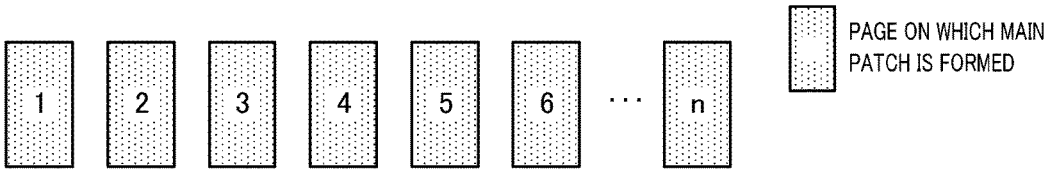
FIG. 5B shows results of printing in the case where a main patch priority mode is set in image forming apparatus 2.

FIG. 5B illustrates results of printing in the case where the main patch priority mode is set in image forming apparatus 2. As illustrated in FIG. 5B, in the case where the main patch priority mode is set, image forming apparatus 2 preferentially forms a main patch and does not form a control patch in the third page and the sixth page.

Figure 5C:
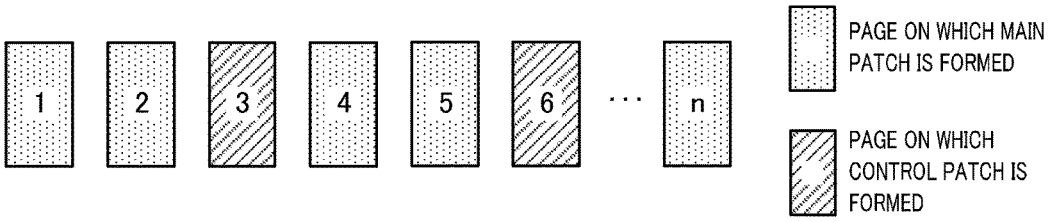
FIG. 5C shows results of printing in the case where a control patch priority mode is set in image forming apparatus 2.

FIG. 5C illustrates results of printing in the case where the control patch priority mode is set in image forming apparatus 2. As illustrated in FIG. 5C, in the case where the control patch priority mode is set, image forming apparatus 2 preferentially forms a control patch and does not form a main patch in the third page and the sixth page.

As illustrated in FIG. 5B and FIG. 5C, in the case where the main patch priority mode or the control patch priority mode is set in image forming apparatus 2, it is possible to prevent image forming apparatus 2 from forming both of the main patch and the control patch.

According to one or more embodiments, the user may determine, for each printing job, which of the main patch and the control patch is preferentially formed when outputting a printing job to image formation system 1 through PC 4, for example. In the following description, the printing job in which the control patch is set to be preferentially formed is referred to as a control patch priority job.

Next, with reference to FIG. 6, the control patch priority job in the case where the main patch priority mode is set in image forming apparatus 2 will be described.

Figure 6:
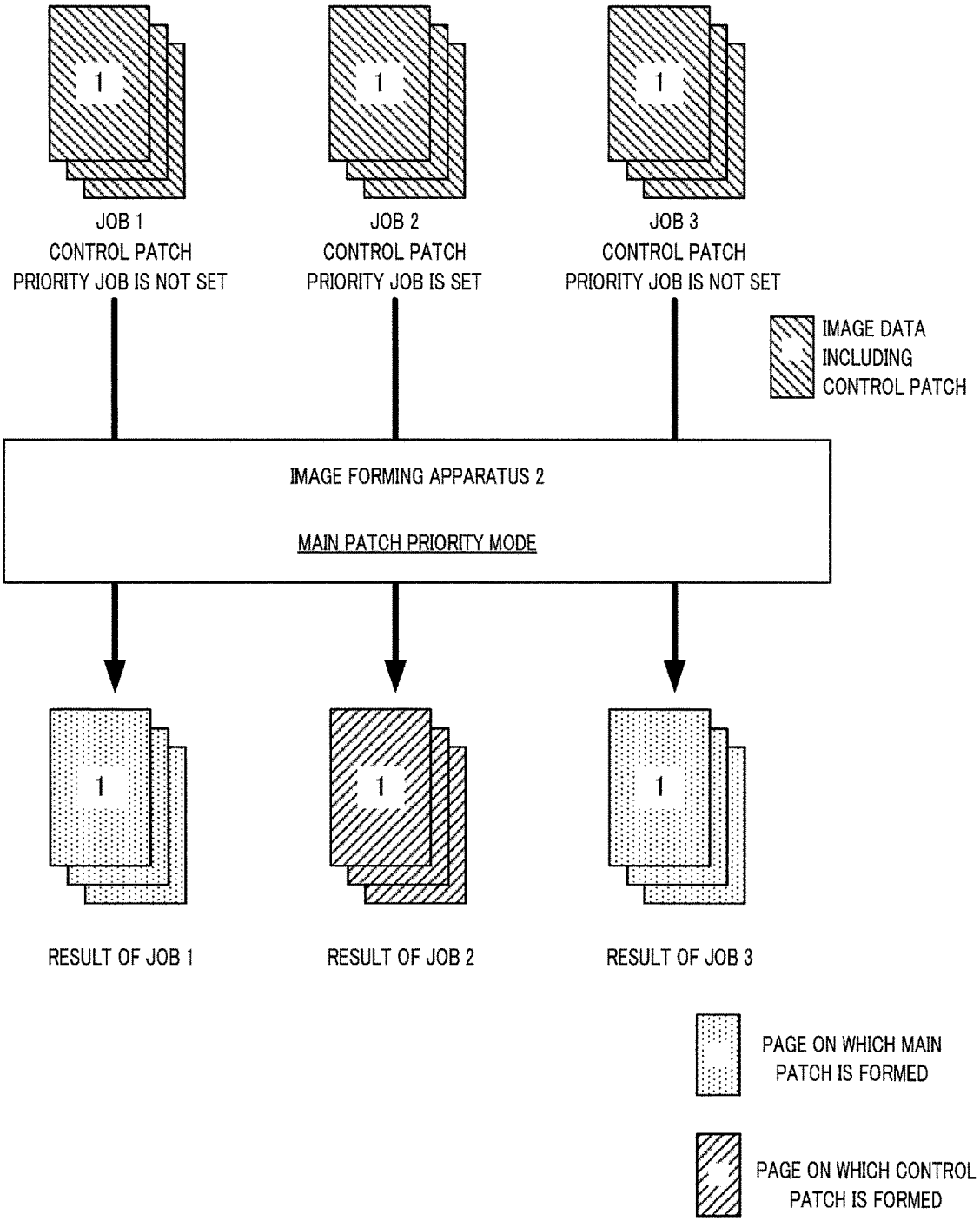
FIG. 6 illustrates an example of a control patch priority job according to one or more embodiments.

FIG. 6 illustrates job 1, job 2, and job 3 which include a control patch in each image data of three pages. In job 1, job 2, and job 3, job 2 is set as the control patch priority job. In addition, FIG. 6 illustrates a result of the case where job 1, job 2, and job 3 are carried out with image forming apparatus 2 set in the main patch priority mode.

As illustrated in FIG. 6, when executing job 1 and job 3 which are not set as the control patch priority job, image forming apparatus 2 set in the main patch priority mode forms a main patch without forming a control patch. On the other hand, when executing job 2 set as the control patch priority job, image forming apparatus 2 set in the main patch priority mode forms a control patch without forming a main patch.

As illustrated in FIG. 5B and FIG. 5C, in image forming apparatus 2, the main patch priority mode of preferentially forming a main patch, or the control patch priority mode of preferentially forming a control patch is set regardless of the number of the printing job. In addition, as illustrated in FIG. 6, in the main patch priority mode, the control patch priority job is set for one printing job.

When executing the control patch priority job, image forming apparatus 2 preferentially forms a control patch and does not form a main patch even in the main patch priority mode. In this case, sheets on which a main patch is not formed are successively provided, and consequently real-time tone correction may not be performed.

To prevent a situation where real-time tone correction cannot be performed, image formation system 1 controls the setting of the number of continuous pages of the control patch in which a main patch is formed without forming a control patch when the number of sheets on which a control patch is continuously formed is greater than a predetermined number of sheets.

Figure 7A:
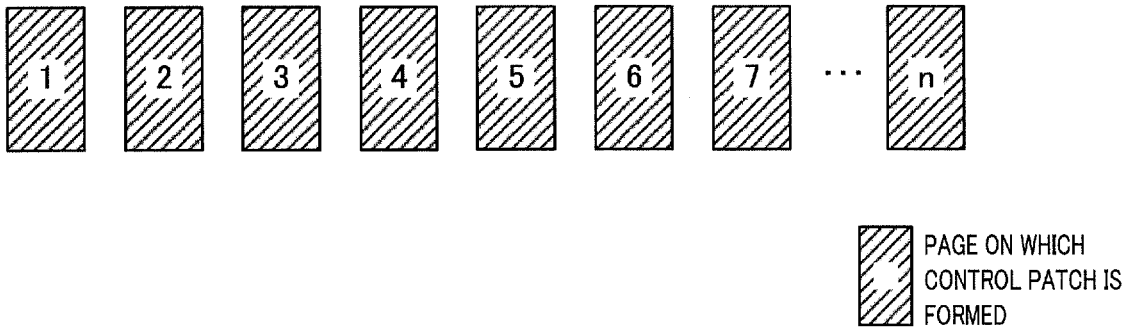
FIG. 7A and FIG. 7B illustrate an example of setting of the number of continuous pages of the control patch.
Figure 7B:
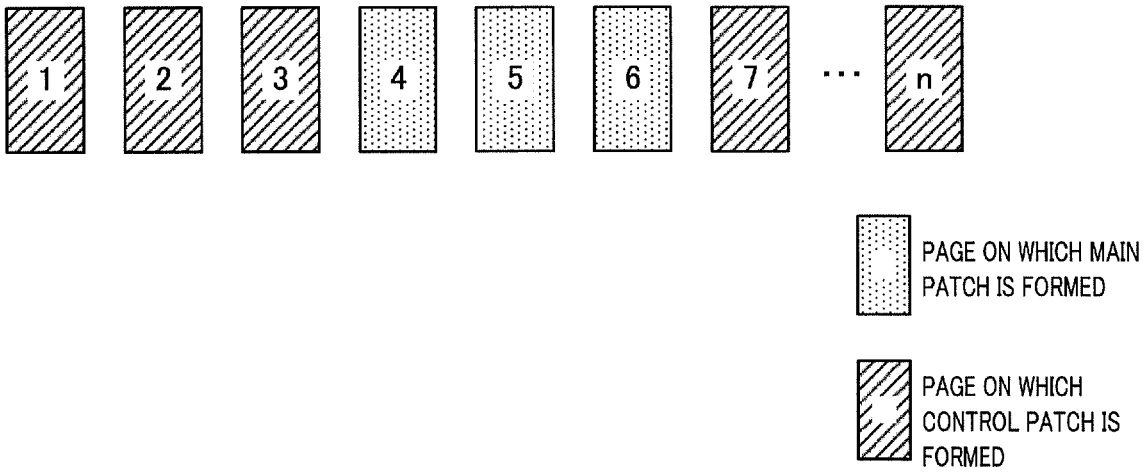

FIG. 7A and FIG. 7B illustrate control of setting of the number of continuous pages of the control patch. As illustrated in FIG. 7A, in the case where a control patch is formed in each of the first page to the nth page, image formation system 1 cannot perform tone correction.

In view of this, as illustrated in FIG. 7B, in the case where a control patch is continuously formed on three sheets, image forming apparatus 2 does not form a control patch after the fourth page, while forming a main patch. Then, after continuously forming a main patch for a predetermined number of sheets (three sheets, in FIG. 7B), image forming apparatus 2 again forms a control patch.

For example, the setting of the number of continuous pages of the control patch is carried out when the user operates operation section 22 to set the number of continuous pages for forming a control patch. In addition, the predetermined number of sheets of the main patch is set in advance in image forming apparatus 2 as the continuous number of sheets of the main patch required for real-time tone correction.

Control section 100 counts the number of sheets on which the control patch has been continuously formed by use of an internal control patch counter. Control section 100 compares the counted number of sheets with the set number of continuous pages to determine whether the number of the sheets on which the control patch has been continuously formed has reached the set number of continuous pages. In addition, control section 100 counts the number of sheets on which the main patch has been continuously formed by use of an internal main patch counter. Control section 100 compares the counted number of sheets with the predetermined number of sheets of the main patch to determine whether the main patch has been continuously formed for a predetermined number of sheets.

Figure 8:
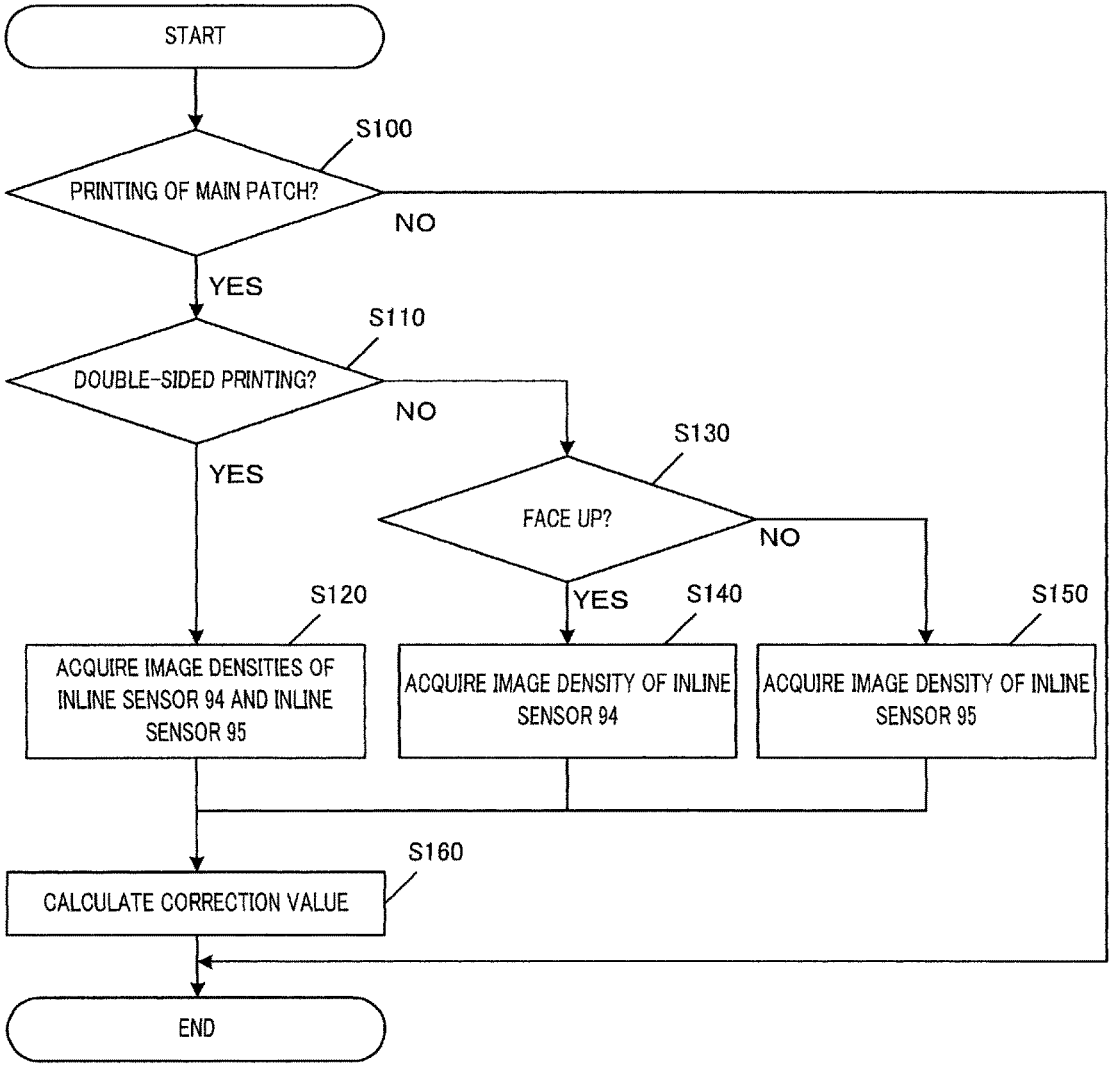
FIG. 8 is a flowchart of an example of a tone correction process according to one or more embodiments.

Next, with reference to FIG. 8, the control of the real-time tone correction according to one or more embodiments will be described.

First, control section 100 determines whether to form a main patch (S100). This determination is performed based on whether a setting for real-time tone correction is set in image formation system 1, for example. When no main patch is formed (NO at S100), the control of the real-time tone correction is completed.

When a main patch is formed (YES at S100), control section 100 determines whether the sheet ejected from image forming apparatus 2 is subjected to double-sided printing (S110).

When the sheet ejected from image forming apparatus 2 is subjected to double-sided printing (YES at S110), control section 100 acquires the image densities of the main patch detected by inline sensor 94 and inline sensor 95 through control section 90 (S120). Then, the control of the real-time tone correction is advanced to S160.

When the sheet ejected from image forming apparatus 2 is not subjected to double-sided printing (NO at S110), control section 100 determines whether the printing surface of the ejected sheet faces upward (face up state) (S130).

When the ejected sheet is in the face up state (YES at S130), control section 100 acquires through control section 90 the image density of the main patch detected by inline sensor 94 (S140). Then, the control of the real-time tone correction is advanced to S160.

When the ejected sheet is not in the face up state (NO at S130), control section 100 acquires the image density of the main patch detected by inline sensor 95 (S150). Then, the control of the real-time tone correction is advanced to S160.

Then, control section 100 calculates a correction value for tone correction based on the image density acquired steps of S120, S140 or S150 (S160). Then, with the calculated correction value, image forming apparatus 2 performs tone correction.

Figure 9:
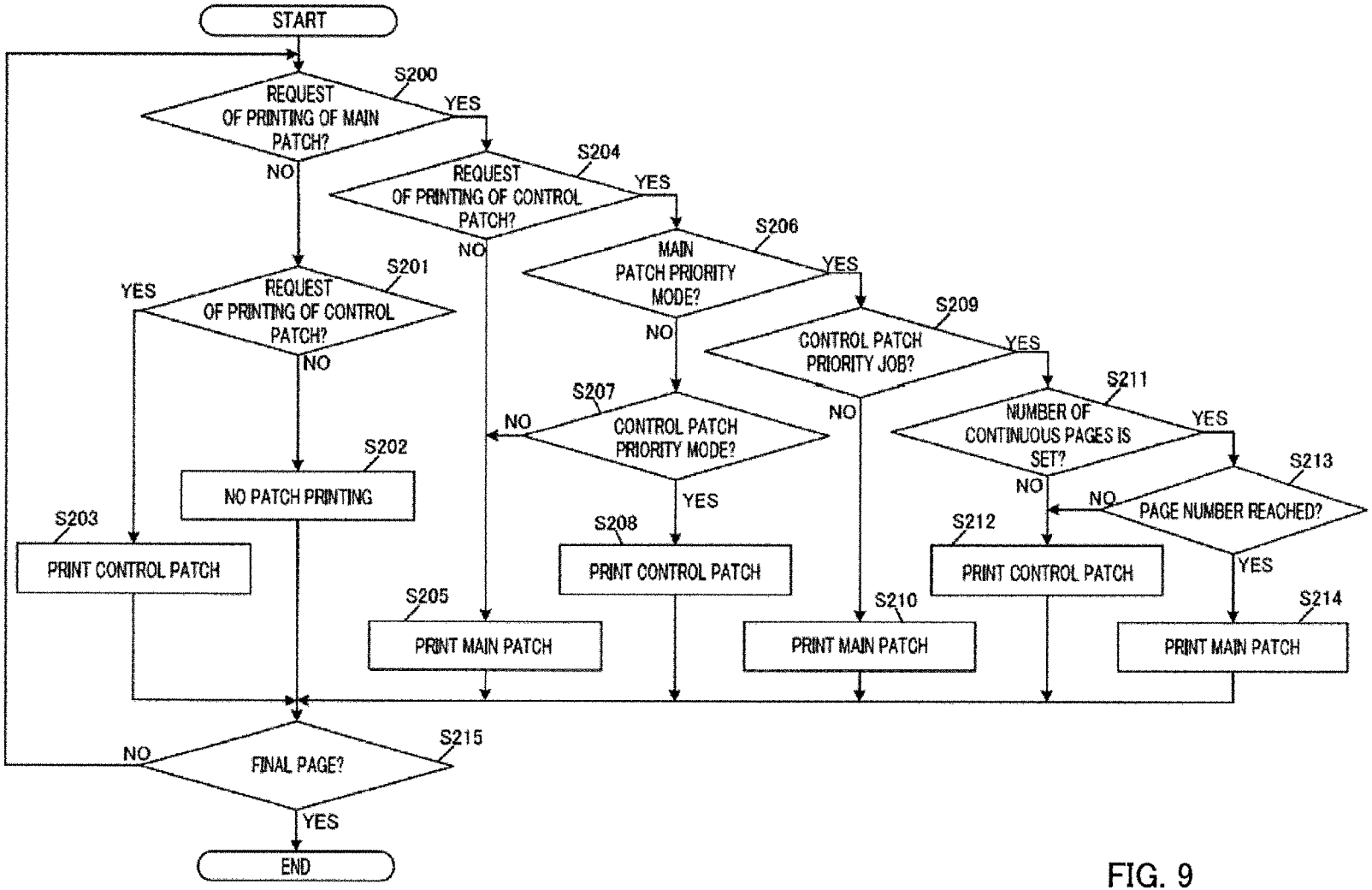
FIG. 9 is a flowchart of an example of a patch formation process according to one or more embodiments.

Next, with reference to FIG. 9, a patch formation process according to one or more embodiments will be described. The patch formation process is started when control section 100 of image forming apparatus 2 receives a printing job, for example.

First, control section 100 determines whether there is a request of forming a main patch on a sheet (S200). This determination is performed based on whether a setting for real-time tone correction is set in image formation system 1, for example.

When there is no request of forming a main patch on a sheet (NO at S200), control section 100 determines whether there is a request of forming a control patch on a sheet (S201). This determination is performed based on whether a control patch is disposed in the image data of the printing job to be carried out.

When there is no request of forming a control patch on a sheet (NO at S201), control section 100 does not control image forming apparatus 2 to form a patch (S202). Then, the patch formation process is advanced to S215. When there is a request of forming a control patch on a sheet (YES at S201), control section 100 controls image forming apparatus 2 to form a control patch (S203). Then, the patch formation process is advanced to S215.

At step S200, when there is a request of forming a main patch on a sheet (YES at S200), control section 100 determines whether there is a request of forming a control patch on a sheet as in S201 (S204).

When there is no request of forming a control patch on a sheet (NO at S204), control section 100 controls image forming apparatus 2 to form a main patch (S205). Then, the patch formation process is advanced to S215. When there is a request of forming a control patch on a sheet (YES at S204), control section 100 determines whether the printing mode set in image formation system 1 is the main patch priority mode (S206).

When the mode set in image formation system 1 is not the main patch priority mode (NO at S206), control section 100 determines whether the printing mode set in image formation system 1 is the control patch priority mode (S207).

When the mode set in image formation system 1 is not the control patch priority mode (NO at S207), that is, when image formation system 1 is not set to the main patch priority mode or the control patch priority mode, control section 100 controls image forming apparatus 2 to form a main patch as the default setting (S205). Then, the patch formation process is advanced to S215.

When the mode set in image formation system 1 is the control patch priority mode (YES at S207), control section 100 controls image forming apparatus 2 to form a control patch (S208). Then, the patch formation process is advanced to S215.

At step S206, when the mode set in image formation system 1 is the main patch priority mode (YES at S206), control section 100 determines whether the printing job under execution is the control patch priority job (S209).

When the printing job under execution is not the control patch priority job (NO at S209), control section 100 controls image forming apparatus 2 to form a main patch (S210). Then, the patch formation process is advanced to S215.

When the printing job under execution is the control patch priority job (YES at S209), control section 100 determines whether the number of continuous pages for forming a control patch is set (S211).

When the number of continuous pages for forming a control patch is not set (NO at S211), control section 100 controls image forming apparatus 2 to form a control patch (S212). Then, the patch formation process is advanced to S215.

When the number of continuous pages for forming a control patch is set (YES at S211), control section 100 determines whether the number of pages on which a control patch has been formed until then has reached the set number of continuous pages (S213).

When the number of pages on which a control patch has been formed has reached the set number of continuous pages (YES at S213), control section 100 controls image forming apparatus 2 to form a main patch (S214). Then, the patch formation process is advanced to S215.

When the number of pages on which a control patch has been formed until then has not reached the set number of continuous pages (NO at S213), control section 100 controls image forming apparatus 2 to form a control patch (S212). Then, the patch formation process is advanced to S215.

Control section 100 determines whether the sheet on which the patch is formed by image forming apparatus 2 is the final page (S215). When the page is not the final page (NO at S215), S200 and the subsequent processes are repeated for the next sheet. When the page is not the final page (YES at S215), the flow of the patch formation process is completed.

As has been described in detail, an image formation system 1 composed of a plurality of units including image forming apparatus 2 configured to form a toner image on a plurality of sheets, image formation system 1 includes: a first patch image formation section configured to form a main patch (first patch image) for performing tone correction of a toner image formed on the sheet in a predetermined region of the sheet; a second patch image formation section configured to form a control patch (second patch image) for monitoring color variation of the toner image formed on the sheet in the predetermined region of the sheet; and a control section 100 configured to control the first patch image formation section and the second patch image formation section such that the first patch image and the second patch image are not formed on one sheet.

According to the above-mentioned configuration, image forming apparatus 2 forms only one of the main patch and the control patch on the sheet, whereby overlapping of the control patch and the main patch on the same sheet can be prevented, and tone correction can be normally performed.

In addition, in image formation system 1, in a setting in which the main patch (first patch image) and the control patch (second patch image) are formed in the predetermined region of one sheet, control section 100 selectively carries out one of a first patch mode and a second patch mode, the first patch mode being a mode for forming the first patch image without forming the second patch image in the predetermined region, the second patch mode being a mode for forming the second patch image without forming the first patch image in the predetermined region.

According to the above-mentioned configuration of one or more embodiments, the user can selectively set the main patch or the control patch to be formed on the sheet by image forming apparatus 2, for example.

In addition, in image formation system 1, control section 100 switches a mode to be carried out between the first patch mode and the second patch mode for each printing job.

According to the above-mentioned configuration of one or more embodiments, the prioritized patch can be switched between the main patch and the control patch for each printing job in accordance with the request of the user.

In addition, in image formation system 1, after the control patch priority mode (second patch mode) is continuously carried out for a predetermined number of sheets, control section 100 operates to carry out the first patch mode for a sheet which is set to be subjected to formation of the main patch (first patch image) and the control patch (second patch image) in the predetermined region.

With the above-mentioned configuration of the present embodiment, succession of sheets on which a main patch is not formed can be prevented, and interruption of real-time tone correction can be prevented.

In image formation system 1, control section 100 generates tone correction data based on the information detected by inline sensors 94 and 95 to perform tone correction in real time as described above. Image formation system 1 according to one or more embodiments may include, in addition to the mode (adjustment mode) of performing real-time tone correction, a mode (monitoring mode) of monitoring color variation without performing tone correction.

Specifically, the monitoring mode is a mode in which control section 100 monitors color variation of a predetermined number of sheets on which a main patch is formed based on the information detected by inline sensors 94 and 95, and the color variation is stored as a time-dependent log in storage section 80. In the case where, in the monitoring mode, the color variation to be stored as the time-dependent log exceeds a predetermined value, or, monitoring of color variation of a predetermined number of sheets is completed, control section 100 switches the mode of image formation system 1 from the monitoring mode to the adjustment mode, and generates tone correction data from the monitored color variation to start tone correction.

Image formation system 1 does not perform tone correction during the monitoring mode, and therefore the accuracy of tone correction is not changed even when a main patch is not formed. In this case, image forming apparatus 2 may prioritize the printing of a control patch without prioritizing the printing of a main patch. Therefore, in the case where image formation system 1 carries out a printing job including a control patch in the monitoring mode, image forming apparatus 2 under the control of control section 100 forms a control patch regardless of whether the mode is the main patch priority mode or the control patch priority mode. In addition, since a main patch is not formed at this time, control section 100 interrupts the monitoring mode.

As described above, in image formation system 1, when a setting for forming the control patch (second patch image) in the predetermined region of a sheet is made in a monitoring mode in which the main patch (first patch image) is formed on the sheet without performing the tone correction, control section 100 operates to form the control patch (second patch image) without forming the main patch (first patch image) in the predetermined region of the sheet.

According to the above-mentioned configuration of one or more embodiments, in the monitoring mode in which tone correction is not carried out, it is not necessary to prioritize the main patch, and therefore a control patch can be preferentially formed.

It is to be noted that, in one or more embodiments, the number of pages subjected to continuous printing of a control patch is limited in the case where the main patch priority mode is set in the image formation system 1 and the printing job under execution is the control patch priority job. Alternatively, the number of pages subjected to continuous printing of a control patch may be limited in the case where the control patch priority mode is set in the image formation system 1.

While the externally connected PC 4 performs the RIP process of an image in one or more embodiments, the present invention is not limited to this. The externally connected apparatus that sends image data to the image formation system 1 may not be a PC. Alternatively, the image forming apparatus main body may perform the RIP process on the image. In this case, the image forming apparatus generates the image data including the control patch.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. An image formation system comprising:

an image forming section comprising a belt and a roller, wherein the image forming section forms, in a predetermined region of a sheet, either:

a first patch image for performing tone correction of a toner image formed on the sheet, or a second patch image for monitoring color variation of the toner image formed on the sheet; and a controller that controls the image forming section to form only one of the first patch image and the second patch image on any one sheet.

2. The image formation system according to claim 1, wherein the controller selectively carries out one of:

a first patch mode for forming the first patch image without forming the second patch image in the predetermined region, and a second patch mode for forming the second patch image without forming the first patch image in the predetermined region.

3. The image formation system according to claim 2, wherein the controller switches between the first patch mode and the second patch mode for each printing job.

4. The image formation system according to claim 3, wherein, after the second patch mode is continuously carried out for a predetermined number of sheets, the controller carries out the first patch mode for a sheet that is set to be subjected to formation of the first patch image and the second patch image in the predetermined region.

5. The image formation system according to claim 3, wherein, when a setting for forming the second patch image in the predetermined region of a sheet is set in a monitoring mode in which the first patch image is formed on the sheet without performing the tone correction, the controller operates to form the second patch image without forming the first patch image in the predetermined region of the sheet.

6. The image formation system according to claim 2, wherein, after the second patch mode is continuously carried out for a predetermined number of sheets, the controller carries out the first patch mode for a sheet that is set to be subjected to formation of the first patch image and the second patch image in the predetermined region.

7. The image formation system according to claim 6, wherein, when a setting for forming the second patch image in the predetermined region of a sheet is set in a monitoring mode in which the first patch image is formed on the sheet without performing the tone correction, the controller operates to form the second patch image without forming the first patch image in the predetermined region of the sheet.

8. The image formation system according to claim 2, wherein, when a setting for forming the second patch image in the predetermined region of a sheet is set in a monitoring mode in which the first patch image is formed on the sheet without performing the tone correction, the controller forms the second patch image without forming the first patch image in the predetermined region of the sheet.

9. The image formation system according to claim 1, wherein, when a setting for forming the second patch image in the predetermined region of a sheet is set in a monitoring mode in which the first patch image is formed on the sheet without performing the tone correction, the controller forms the second patch image without forming the first patch image in the predetermined region of the sheet.

10. An image forming apparatus comprising:

an image forming section comprising a belt and a roller, wherein the image forming section forms, in a predetermined region of a sheet, either:

a first patch image for performing tone correction of a toner image formed on the sheet, or a second patch image for monitoring color variation of the toner image formed on the sheet; and a controller that controls the image forming section to form only one of the first patch image or the second patch image on any one sheet.

11. An image formation method comprising:

forming, in a predetermined region of a sheet, either:

a first patch image for performing tone correction of a toner image formed on the sheet, or a second patch image for monitoring color variation of the toner image formed on the sheet; and controlling a timing of forming the first patch image and the second patch image to form only one of the first patch image and the second patch image on one sheet.

* * * * *